US011281145B2

(12) United States Patent
Fukuhara

(10) Patent No.: US 11,281,145 B2
(45) Date of Patent: Mar. 22, 2022

(54) IMAGE FORMING APPARATUS AND CONTROL METHOD THEREOF

(71) Applicant: TOSHIBA TEC KABUSHIKI KAISHA, Tokyo (JP)

(72) Inventor: Takanori Fukuhara, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/899,909

(22) Filed: Jun. 12, 2020

(65) Prior Publication Data

US 2021/0072688 A1 Mar. 11, 2021

Related U.S. Application Data

(63) Continuation of application No. 16/566,470, filed on Sep. 10, 2019, now Pat. No. 10,719,044.

(51) Int. Cl.

*G03G 15/00* (2006.01)
*G03G 15/08* (2006.01)
*G03G 21/18* (2006.01)

(52) U.S. Cl.

CPC ..... *G03G 15/5016* (2013.01); *G03G 15/0856* (2013.01); *G03G 15/0863* (2013.01); *G03G 15/553* (2013.01); *G03G 15/556* (2013.01); *G03G 21/1875* (2013.01); *G03G 2215/0888* (2013.01)

(58) Field of Classification Search

CPC ..... G03G 15/5016; G03G 15/0856; G03G 15/0863; G03G 15/553; G03G 15/556; G03G 21/1875; G03G 2215/0888

See application file for complete search history.

(56) References Cited

U.S. PATENT DOCUMENTS

| | | | | |
|---|---|---|---|---|
| 9,715,206 | B1 | 7/2017 | Luke et al. | |
| 2002/0085847 | A1* | 7/2002 | Yoshida | G03G 15/55 399/12 |
| 2006/0045546 | A1 | 3/2006 | Okochi | |
| 2012/0014701 | A1 | 1/2012 | Tokuno et al. | |
| 2012/0219307 | A1* | 8/2012 | Suzuki | G03G 15/0855 399/27 |
| 2013/0004187 | A1 | 1/2013 | Watanabe | |

(Continued)

FOREIGN PATENT DOCUMENTS

| | | |
|---|---|---|
| JP | 2011-191433 A | 9/2011 |
| JP | 2015-079188 A | 4/2015 |

*Primary Examiner* — Ryan D Walsh
(74) *Attorney, Agent, or Firm* — Kim & Stewart LLP

(57) ABSTRACT

An image forming apparatus includes a sensor configured to detect a remaining amount of a recording agent in a cartridge mounted in the image forming apparatus, an output device configured to output at least one of visual and audio information, and a controller. The controller is configured to, upon a first cartridge being dismounted, store, as a previous remaining amount, a remaining amount of a recording agent in the first cartridge detected by the sensor. The controller is also configured to, upon a remaining amount of a recording agent in a second cartridge that has been mounted in the image forming apparatus after the first cartridge is dismounted decreasing to or below a first threshold value as detected by the sensor, control the output device to output information that varies based on a value of the previous remaining amount.

20 Claims, 6 Drawing Sheets

(56) References Cited

U.S. PATENT DOCUMENTS

| | | | |
|---|---|---|---|
| 2015/0104200 | A1 | 4/2015 | Matsumoto |
| 2015/0125167 | A1 | 5/2015 | Yamaguchi et al. |
| 2015/0316884 | A1 | 11/2015 | Shinagawa |
| 2016/0231684 | A1 | 8/2016 | Osuki |
| 2018/0299816 | A1 | 10/2018 | Sakaguchi et al. |

* cited by examiner

FIG. 4

| PREVIOUS REMAINING AMOUNT | FIRST WARNING PROCESS | SECOND WARNING PROCESS |
|---|---|---|
| LARGE | NON-REPLACEMENT WARNING | EMPTY WARNING |
| MEDIUM | NEAR EMPTY WARNING | EMPTY WARNING |
| SMALL | NON-EXECUTION OF WARNING | EMPTY WARNING |

FIG. 5

| PREVIOUS REMAINING AMOUNT | FIRST WARNING PROCESS | SECOND WARNING PROCESS |
|---|---|---|
| LARGE | NON-REPLACEMENT WARNING | REDUCTION OF SECOND THRESHOLD VALUE/ EMPTY WARNING |
| MEDIUM | NEAR EMPTY WARNING | EMPTY WARNING |
| SMALL | NON-EXECUTION OF WARNING | REDUCTION OF SECOND THRESHOLD VALUE/ EMPTY WARNING |

IMAGE FORMING APPARATUS AND CONTROL METHOD THEREOF

CROSS-REFERENCE TO RELATED APPLICATION

This application is a continuation of U.S. patent application Ser. No. 16/566,470, filed on Sep. 10, 2019, the entire contents of each of which are incorporated herein by reference.

FIELD

Embodiments described herein relate generally to an image forming apparatus and a control method thereof.

BACKGROUND

In the related art, when toner in a toner cartridge is running out, an image forming apparatus outputs a display urging a user to replace the toner cartridge. When the output timing of the display is too early, the toner cartridge is replaced in a state where a large amount of toner remains therein, and therefore a large amount of toner may be wasted. When the output timing of the display is too late, the toner in the image forming apparatus may be insufficient and thus a problem such as printing failure, and the like may occur. In order to solve the problem described above, there is a technology for detecting a remaining amount of the toner in the toner cartridge with high accuracy.

However, even though the display urging a user to replace the toner cartridge is output, the replacement may be too early depending on a person who performs the replacement. As a result, there still remains a problem that the toner cartridge is replaced in a state where a large amount of toner remains and the toner in the replaced toner cartridge is wasted. The above-described problem is not limited to a toner, and is common to all recording agents such as ink, and the like.

DESCRIPTION OF THE DRAWINGS

FIG. 4 is a diagram illustrating a first specific example of a warning table.

FIG. 5 is a diagram illustrating a second specific example of the warning table.

DETAILED DESCRIPTION

In general, according to an embodiment, an image forming apparatus includes a sensor configured to detect a remaining amount of a recording agent in a cartridge mounted in the image forming apparatus, an output device configured to output at least one of visual and audio information, and a controller. The controller is configured to, upon a first cartridge being dismounted, store, as a previous remaining amount, a remaining amount of a recording agent in the first cartridge detected by the sensor. The controller is also configured to, upon a remaining amount of a recording agent in a second cartridge that has been mounted in the image forming apparatus after the first cartridge is dismounted decreasing to or below a first threshold value as detected by the sensor, control the output device to output information that varies based on a value of the previous remaining amount.

Figure 1:
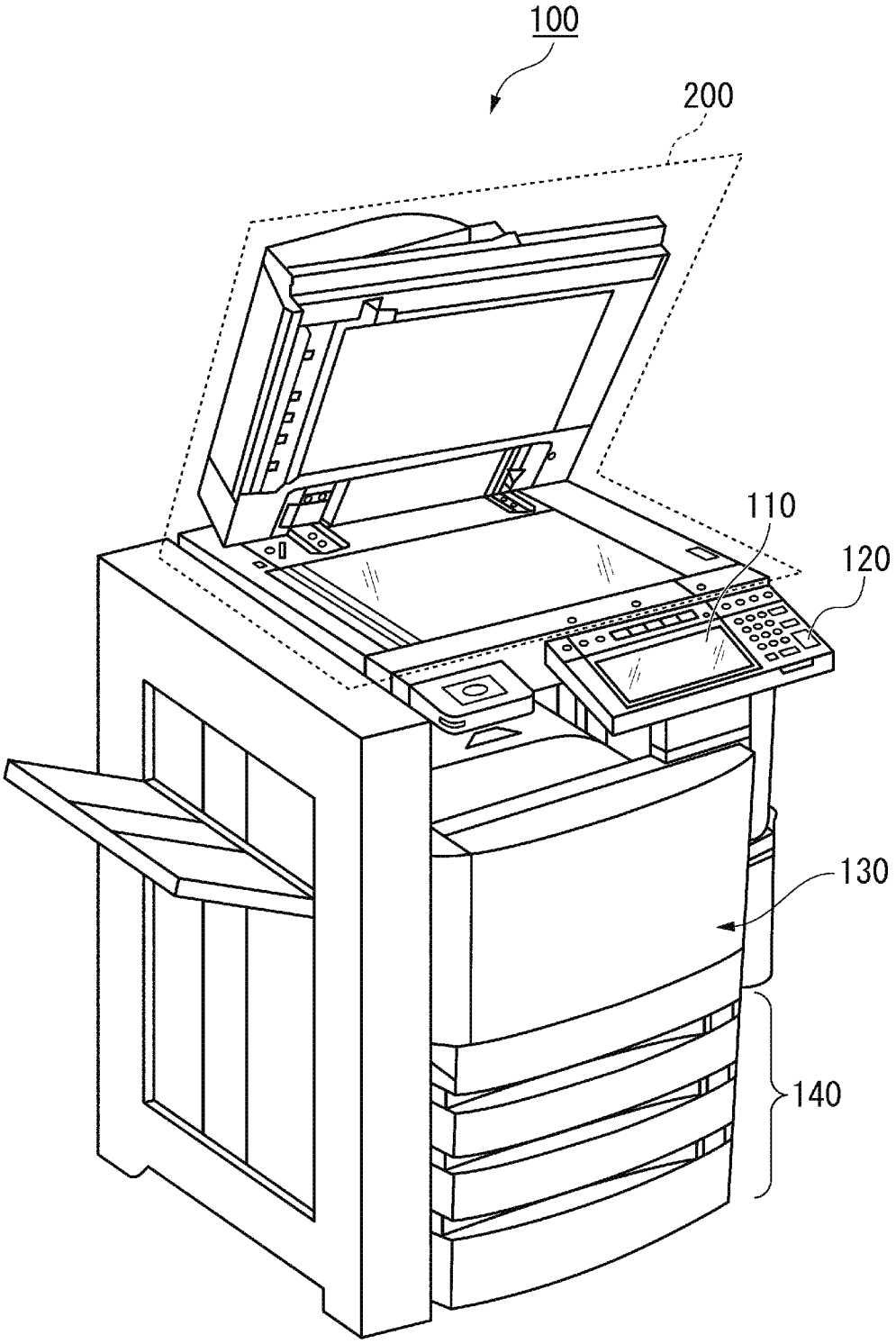
FIG. 1 illustrates an external view of an image forming apparatus according to an embodiment.

FIG. 1 illustrates an external view of an image forming apparatus 100 according to an embodiment. The image forming apparatus 100 is, for example, a multi-functional peripheral. The image forming apparatus 100 includes a display 110, a control panel 120, an image forming unit 130, a sheet accommodating unit 140, and an image reading unit 200. Further, the image forming unit 130 of the image forming apparatus 100 may be an apparatus for fixing a toner image or an inkjet type apparatus. Toner and ink cartridges are commonly referred to as a recording agent cartridge. Further, the recording agent cartridge also includes a recording agent cartridge which is loaded with either one of two types of decoloring toner which can be decolored or toner which cannot be decolored.

The image forming apparatus 100 forms an image on a sheet by using a recording agent such as a toner. The sheet is, for example, paper or label paper. The sheet may be any object as long as the image forming apparatus 100 can form an image on a surface thereof.

The display 110 is an image display device such as a liquid crystal display, an organic EL (Electro Luminescence) display, and the like. The display 110 displays various types of information related to the image forming apparatus 100.

The control panel 120 includes a plurality of buttons. The control panel 120 receives an operation of a user. The control panel 120 outputs a signal corresponding to the operation performed by the user to a control unit 160 of the image forming apparatus 100. Further, the display 110 and the control panel 120 may be configured as an integrated touch panel.

The image forming unit 130 forms an image on a sheet based upon image information generated by the image reading unit 200 or the image information received via a communication path. The image forming unit 130 forms the image by, for example, the following process. The image forming unit 130 forms an electrostatic latent image on a photoreceptor drum based upon the image information. The image forming unit 130 forms a visible image by depositing the recording agent on the electrostatic latent image. As a specific example of the recording agent, toner is used. As an example of the toner, decoloring toner, non-decoloring toner (normal toner), a decorative toner, and the like are included. The colors of some recording agents fade (disappear) by heating. Such a recording agent is referred to as a decoloring developer in the following description. The decoloring toner is a specific example of the decoloring developer.

The image forming unit 130 transfers the visible image on the sheet. The image forming unit 130 fixes the visible image on the sheet by heating and pressurizing the sheet. Further, the sheet on which the image is formed may be a sheet accommodated in the sheet accommodating unit 140 or may be a manually inserted sheet.

The image reading unit 200 reads image information, which is a target to be read as light and shade of light. The image reading unit 200 records the read image information.

The recorded image information may be transmitted to another information processing apparatus via a network. The recorded image information may be formed as an image on the sheet by the image forming unit 130.

Figure 2:
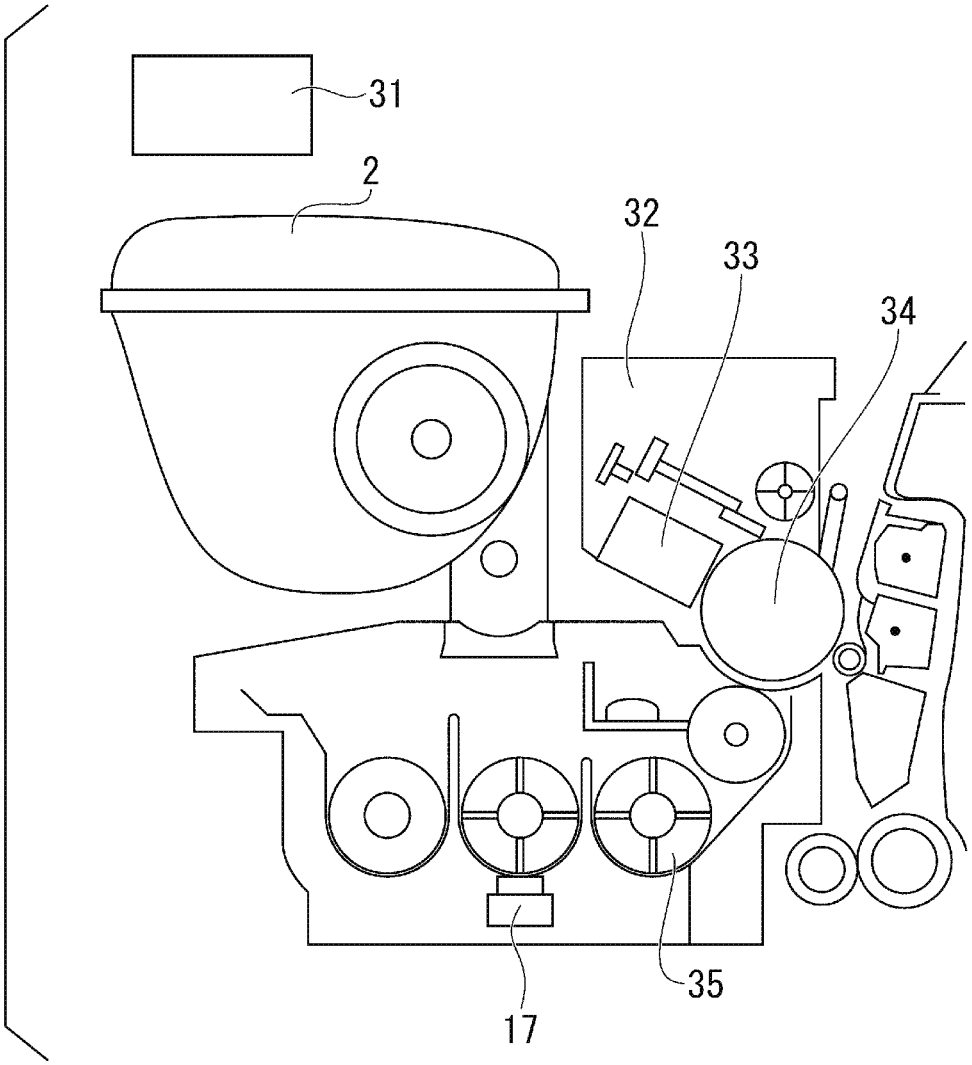
FIG. 2 is a diagram illustrating a configuration example of a part of an image forming unit.

FIG. 2 is a diagram illustrating a configuration example of a part of the image forming unit 130. The image forming unit 130 includes a cartridge 2 (recording agent cartridge), a sensor 17, a recording agent replenishment motor 31, a cleaning unit 32, an electrification charger 33, a photoreceptor 34, and a developing device 35.

The sensor 17 detects density or a remaining amount of the recording agent remaining in the developing device 35 of the image forming apparatus 100. The cartridge 2 is attachable and detachable with respect to the image forming apparatus 100 and is filled with the recording agent. The recording agent replenishment motor 31 is a motor operating when the recording agent in the cartridge 2 is replenished to the developing device 35. The cleaning unit 32 removes the recording agent attached on the surface of the photoreceptor 34. The electrification charger 33 charges the surface of the photoreceptor 34. The photoreceptor 34 includes a surface on which an image is formed by the recording agent. The developing device 35 can store the recording agent and supplies the recording agent to the photoreceptor 34 by a developing roller.

Figure 3:
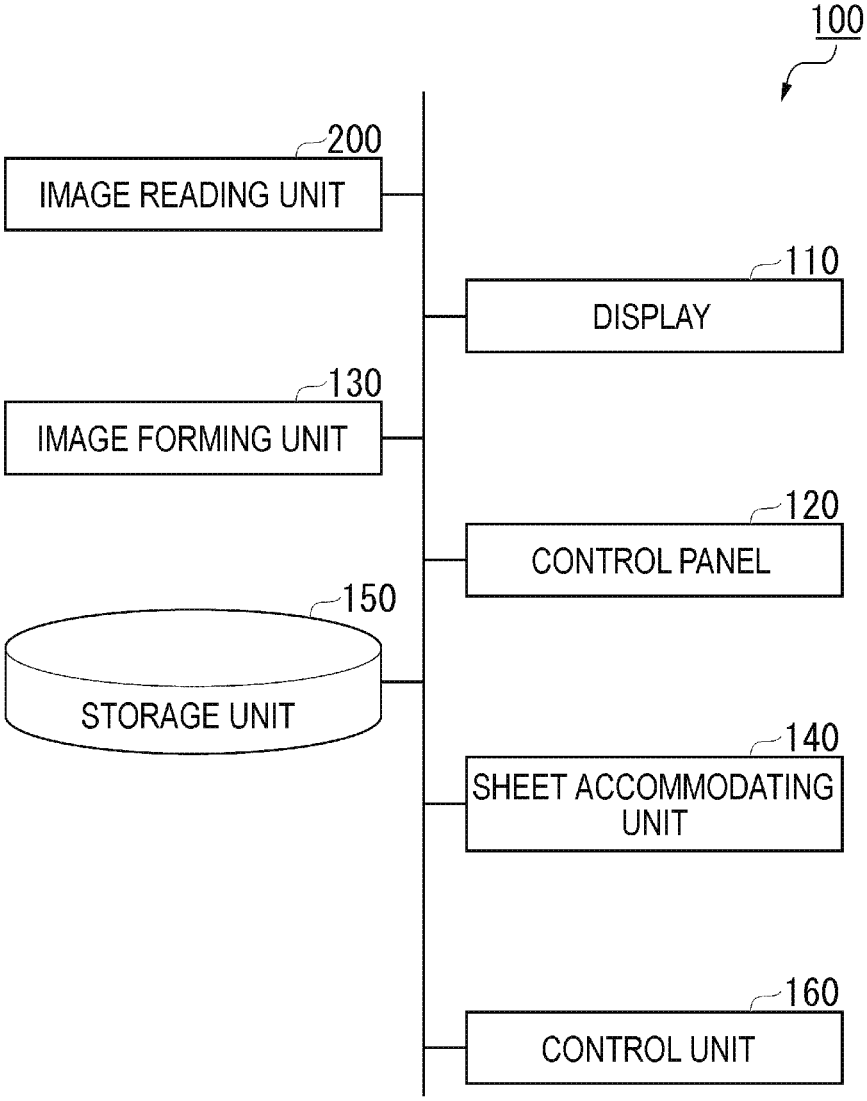
FIG. 3 is a hardware block diagram of the image forming apparatus.

FIG. 3 is a hardware block diagram of the image forming apparatus 100 according to the embodiment. The image forming apparatus 100 includes the image reading unit 200, the display 110, the control panel 120, the image forming unit 130, the sheet accommodating unit 140, a storage unit 150, and the control unit 160. Since the image reading unit 200, the display 110, the control panel 120, the image forming unit 130, and the sheet accommodating unit 140 among the components of the hardware are already described, and thus the descriptions thereof will be omitted.

The storage unit 150 is configured by using a storage device such as a magnetic hard disk device, a semiconductor storage device, and the like. The storage unit 150 stores data required when the image forming apparatus 100 operates. The storage unit 150 may temporarily store image data formed in the image forming apparatus 100. The storage unit 150 may store the image data generated by the image reading unit 200.

The storage unit 150 stores remaining amount information (hereinafter referred to as a "current remaining amount") related to the current cartridge 2 among the pieces of information on the amount of the recording agent estimated to remain in the cartridge 2 (hereinafter referred to as "remaining amount information"). The remaining amount information is acquired by the control unit 160 based upon a physical quantity acquired by a predetermined sensor. The physical quantity may be, for example, the number of rotations of the recording agent replenishment motor 31 and the rotational time thereof from the time the cartridge 2 is mounted to the current time. In this case, a sensor for detecting the number of rotations of the recording agent replenishment motor 31 is used. A sensor and a timer for detecting the rotation of the recording agent replenishment motor 31 may be used. The physical quantity may be, for example, information on the concentration detected by the sensor 17. The remaining amount information may be, for example, information on the remaining amount detected by the sensor 17.

The storage unit 150 stores a warning table. The warning table is a table including a plurality of combinations of content of first warning and a content of second warning in association with a previous remaining amount. The first warning indicates the content of warning to be executed when the current remaining amount becomes less than a first threshold value and equal to or more than a second threshold value. The second warning indicates the content of warning to be executed when the current remaining amount becomes less than the second threshold value. The previous remaining amount indicates the remaining amount information on when the cartridge 2 mounted before the cartridge 2 being currently mounted is replaced. The previous remaining amount is recorded in the storage unit 150 by the control unit 160.

FIG. 4 is a diagram illustrating a first specific example of the warning table. In the warning table illustrated in FIG. 4, three combinations of the previous remaining amount, the first warning, and the second warning are registered. When the previous remaining amount is "large", it is indicated that the cartridge 2 previously mounted is replaced while a large amount of recording agent still remains. In this case, a non-replacement warning is output as the first warning. The non-replacement warning is a character or an image for urging a user not to replace the cartridge 2. As the second warning, an empty warning is output. The empty warning is a character or an image for urging the user to replace the cartridge 2 in order to correctly perform image formation because the amount of recording agent in the cartridge 2 is small.

When the first warning is performed, a considerable time was elapsed since the cartridge 2 was replaced, so that some users may be worried that the recording agent does not remain enough. Particularly, it can be estimated that a user who has the previous remaining amount of "large" highly tends to feel that way. Such a user may replace the cartridge 2 early. Therefore, the user who has the previous remaining amount of "large" can be encouraged to use the same cartridge 2 at ease over a longer period by outputting the non-replacement warning in this manner.

When the previous remaining amount is "medium", it is indicated that the cartridge 2 previously mounted is replaced in a state where a medium-sized amount of recording agent remains. In this case, a near empty warning is output as the first warning. The near empty warning is a character or an image for notifying a user that the replacement time of the cartridge 2 is approaching. As the second warning, the empty warning is output.

When the previous remaining amount is "small", it is indicated that the remaining amount of the recording agent is extremely small at the point of time when the previously mounted cartridge 2 is replaced. In this case, the output of the warning is not executed at the timing when the first warning is performed. As the second warning, the empty warning is output. For example, even though the warning is output with the near empty warning, when the user still thinks that the cartridge 2 is not required to be replaced yet, the user may feel that the display of the near empty warning is troublesome. Particularly, in the case of the user who has the previous remaining amount of "small", there is a high possibility that the user may think that the recording agent still remains and thus the image forming can be executed normally at the timing when the first warning is performed. Therefore, as described above, the warning is not output at the timing when the first warning is performed, so that the user who has the previous remaining amount of "small" can perform the normal operation without feeling troublesome with the unnecessary warning display over a longer period.

Further, whether the previous remaining amount is "large", "medium", or "small" may be actually determined by a predetermined threshold value according to each value of the previous remaining amount ("large", "medium", "small", and the like).

FIG. 5 is a diagram illustrating a second specific example of the warning table. Three combinations of the previous remaining amount, the first warning, and the second warning are registered in the warning table illustrated in FIG. 5. When the previous remaining amount is "large", the non-replacement warning is output as the first warning. Second threshold value reduction process and the empty warning are defined as the second warning. When the second threshold value reduction process is defined as the second warning, the value of the second threshold value indicating the timing of executing the second warning is updated to a value lower than the predetermined second threshold value. That is, the output of the empty warning is on standby until the current remaining amount reaches a value indicating a lower value. When the empty warning is output, a user may be worried that the recording agent is insufficient such that the user may replace the cartridge 2. Therefore, the user who has the previous remaining amount of "large" can be encouraged to use the same cartridge 2 over a longer period by performing the second threshold value reduction process in this manner.

When the previous remaining amount is "middle", the near empty warning is output as the first warning. As the second warning, the empty warning is output.

When the previous remaining amount is "small", the output of the warning is not executed at the timing when the first warning is performed. The execution of the second warning is on standby until the current remaining amount reaches a value indicating a lower value. Even though the empty warning is output, when the user still thinks that the cartridge 2 is not required to be replaced yet, the user may feel that the display of the empty warning is troublesome. Particularly, in the case of the user who has the previous remaining amount of "small", there is a high possibility that the user may think that a little recording agent still remains and thus the image forming can be executed normally even at the timing when the second warning is performed. For that reason, the user who has the previous remaining of "small" can perform the normal operation without feeling troublesome with the unnecessary warning display over a longer period by performing the second threshold value reduction process in this manner. Further, whether the previous remaining amount is "large", "medium", or "small" may be actually determined by a predetermined threshold value according to each value of the previous remaining amount ("large", "medium", "small", and the like).

Referring back to FIG. 3, the control unit 160 is configured by using a processor such as a CPU (Central Processing Unit), and the like and a memory. The control unit 160 reads and executes a program stored in advance in the storage unit 150. The control unit 160 controls the operation of each device provided in the image forming apparatus 100. The control unit 160 acquires the current remaining amount based upon the number of rotations of the recording agent replenishment motor 31, the rotational time thereof, or the output of the sensor 17, and records the acquired current remaining amount in the storage unit 150. The control unit 160 controls the display to be output on the display 110 according to the warning table and the current remaining amount stored in the storage unit 150.

Figure 6:
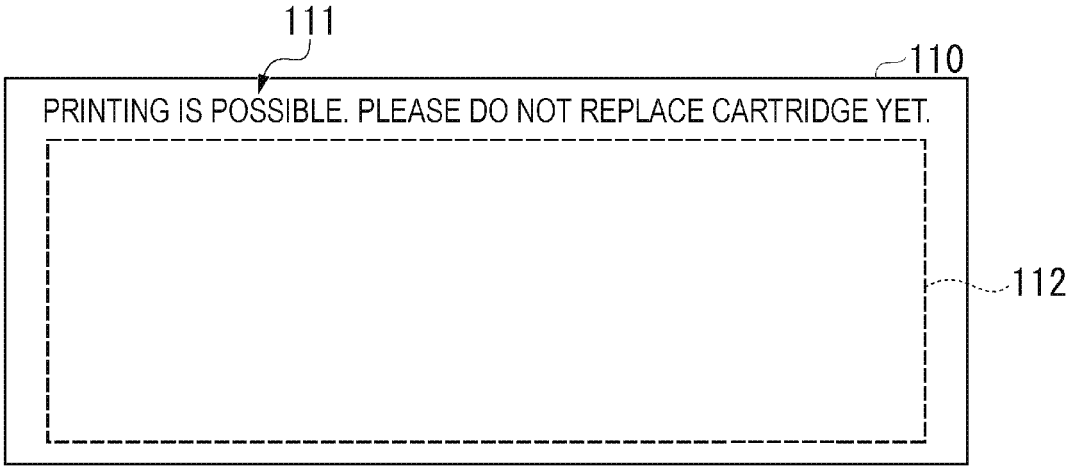
FIG. 6 is a diagram illustrating a specific example of a display of a non-replacement warning.

FIG. 6 is a diagram illustrating a specific example of the display of the non-replacement warning. A warning display area 111 and a normal display area 112 are provided on a screen of the display 110. The warning displays such as the non-replacement warning, the near empty warning, and the empty warning are output in the warning display area 111. A screen (normal screen) for a user to operate the image forming apparatus 100 is displayed in the normal display area 112. In the example of FIG. 6, characters indicating that "printing is possible. Please, do not replace the cartridge yet." are displayed as the non-replacement warning in the warning display area 111.

Figure 7:
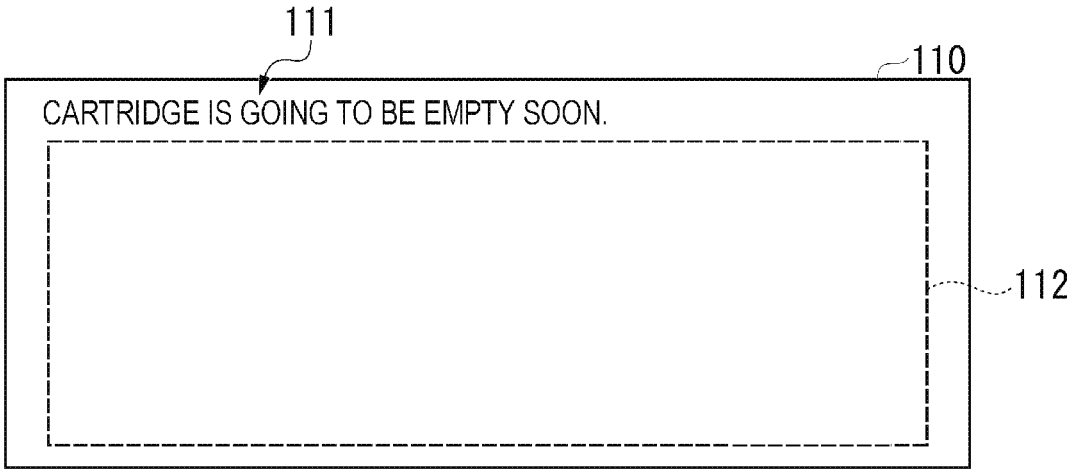
FIG. 7 is a diagram illustrating a specific example of a display of a near empty warning.

FIG. 7 is a diagram illustrating a specific example of the display of the near empty warning. The warning display area 111 and the normal display area 112 are provided on the screen of the display 110. In the example of FIG. 7, characters indicating that "the cartridge is about to be emptied" are displayed as the near empty warning in the warning display area 111.

Figure 8:
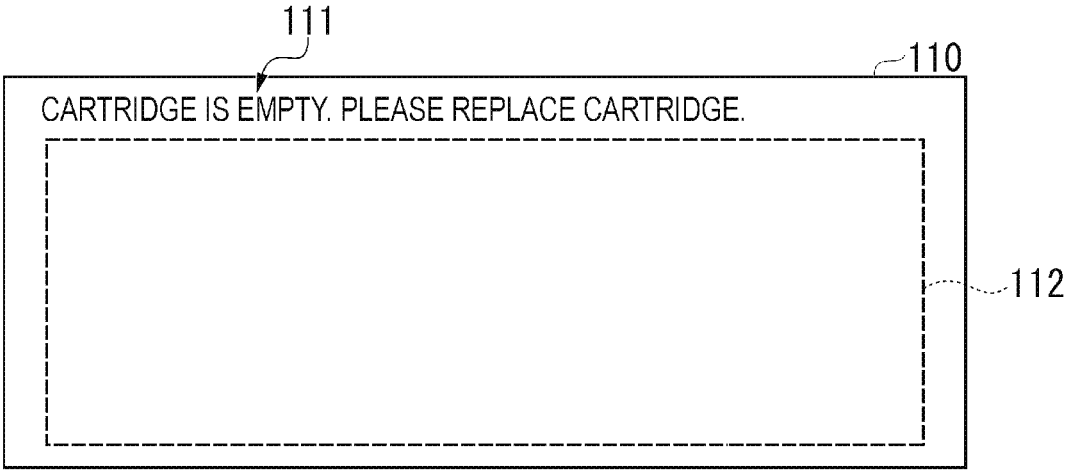
FIG. 8 is diagram illustrating a specific example of a display of an empty warning.

FIG. 8 is a diagram illustrating a specific example of the display of the empty warning. The warning display area 111 and the normal display area 112 are provided on the screen of the display 110. In the example of FIG. 8, characters indicating that "the cartridge is empty. Please, replace the cartridge." are displayed in the warning display area 111, as the empty warning.

Figure 9:
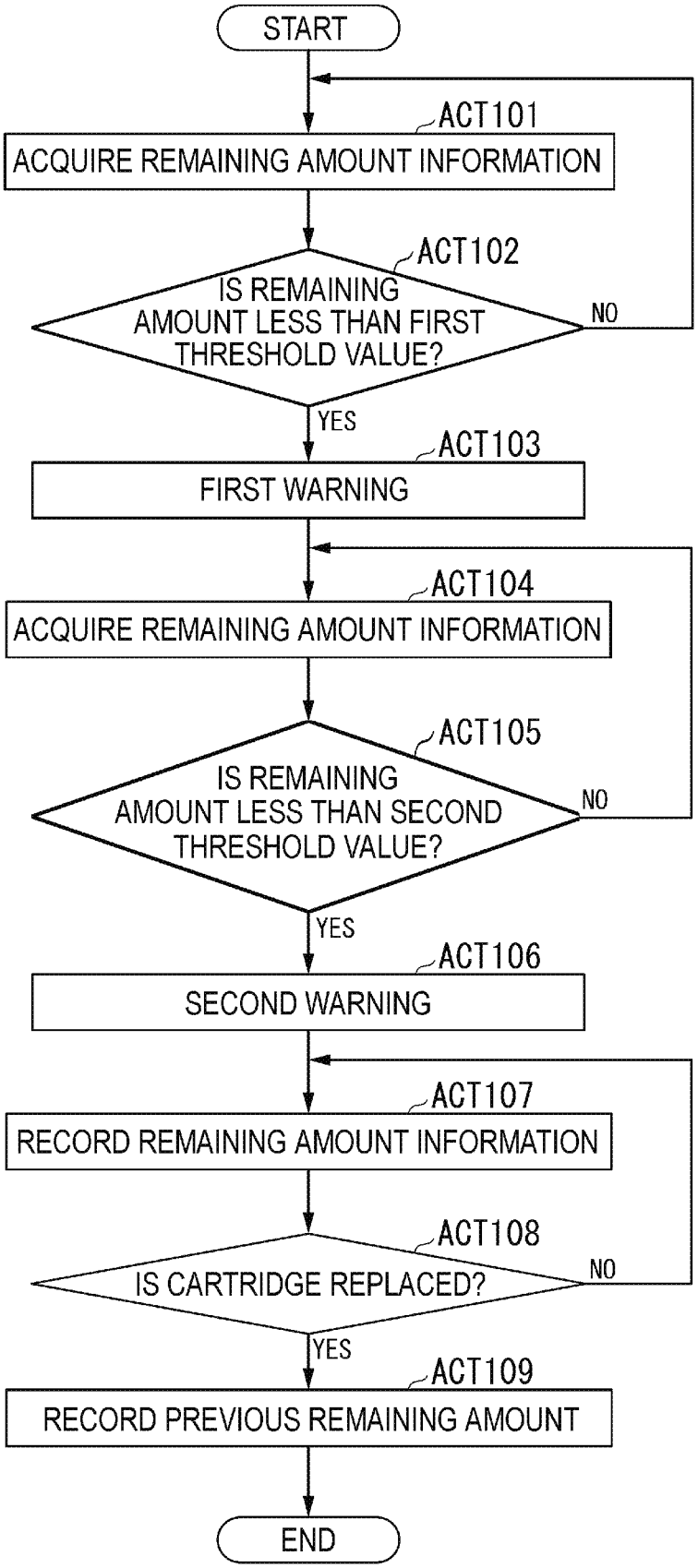
FIG. 9 is a flowchart illustrating a specific example of an operation of a control unit.

FIG. 9 is a flowchart illustrating a specific example of the operation of the control unit 160. The control unit 160 acquires a current remaining amount at a predetermined timing (ACT 101). When the current remaining amount is not less than the first threshold value (ACT 102; NO), the process returns to ACT 101 without the control unit 160 displaying a warning in the warning display area 111.

On the other hand, when the remaining amount of the recording agent indicated by the current remaining amount is less than the first threshold value (ACT 102; YES), the control unit 160 executes the first warning (ACT 103). The content of the first warning to be executed at this time is determined based upon the remaining amount information (previous remaining amount) at the timing when the first previous cartridge 2 is replaced. For example, when the previous remaining amount is "large", the process is performed based upon the first warning in which the previous remaining amount is "large" among the pieces of information registered in the warning table.

Thereafter, the control unit 160 acquires the current remaining amount at the predetermined timing (ACT 104). When the remaining amount of the recording agent indicated by the current remaining amount is not less than the second threshold value (ACT 105; NO), the control unit 160 continues the first warning and the process returns to ACT 104.

On the other hand, when the remaining amount of the recording agent indicated by the current remaining amount is less than the second threshold value (ACT 105; YES), the control unit 160 executes the second warning (ACT 106). The content of the second warning to be executed at this time is determined based upon the remaining amount information (previous remaining amount) at the timing when the first previous cartridge 2 is replaced. For example, when the previous remaining amount is "large", the process is performed based upon the second warning in which the previous remaining amount is "large" among the pieces of information registered in the warning table.

Thereafter, the control unit 160 acquires the current remaining amount at the predetermined timing and records the acquired current remaining amount in the storage unit 150 (ACT 107). The process of ACT 107 is repeatedly executed until the cartridge 2 is replaced (ACT 108; NO). When the cartridge 2 is replaced (ACT 108), the control unit 160 records the latest current remaining amount recorded in the storage unit 150 at that time as a previous remaining amount (ACT 109). Further, the process of recording the latest current remaining amount as the previous remaining amount by the control unit 160 is performed at the timing when the cartridge 2 is replaced regardless of the remaining amount of the recording agent. That is, even though the current remaining amount is not less than the second threshold value, the control unit 160 may record the latest current remaining amount as the previous remaining amount at the timing when the cartridge 2 is replaced. Further, whether or not the cartridge 2 is replaced is detected by a sensor installed near the cartridge 2. For example, when the cartridge 2 is mounted, a sensor that detects the mounting of the cartridge 2 by contacting a part of the cartridge 2 may be used. For example, an optical sensor, in which an optical path is block when the cartridge 2 is mounted, may be used. The control unit 160 resets the current remaining amount after recording the previous remaining amount.

In the image forming apparatus 100 configured as described above, the content of the warning is determined based upon the remaining amount information (previous remaining amount) at the timing when the first previous cartridge 2 is replaced. For example, when the previous remaining amount is "large", a character or an image for urging a user not to replace the cartridge 2 is output as the non-replacement warning. Thus, it is possible to prevent a user who tends to immediately replace the cartridge 2 according to the display of the warning, particularly, such as a user who has the previous remaining amount of "large" from replacing the cartridge 2 which is still usable. As a result, it is possible to effectively utilize the same cartridge 2 which is usable over a longer period.

[Modification]

In the embodiment described above, the output of the warning is performed as a display on the display 110, but the display is not required to be limited to the display on the display 110. For example, a voice indicating a warning may be output from a speaker or the warning may be output at a communication terminal device communicably connected to the image forming apparatus 100.

The previous remaining amount is not necessarily required to be the remaining amount information itself at the timing when the first previous cartridge 2 is replaced. For example, the previous remaining amount may be determined based upon the remaining amount information at the timing when the first previous cartridge 2 is replaced and the remaining amount information at the timing when the second previous cartridge 2 is replaced. That is, the previous remaining amount may be determined based upon a statistic value of one or a plurality of pieces of remaining amount information at the timing when the cartridge 2 is replaced in the past.

The warning is not necessarily required to be two kinds of the first warning and the second warning, and three or more kinds of warning may be used. In this case, it is desirable that a number of threshold values corresponding to each warning are also set in advance.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

a sensor configured to detect a remaining amount of a recording agent in a cartridge mounted in the image forming apparatus;

an output device configured to output at least one of visual and audio information; and a controller configured to:

upon a first cartridge being dismounted, store in a storage device, as a previous remaining amount, a remaining amount of a recording agent in the first cartridge detected by the sensor; and upon a remaining amount of a recording agent in a second cartridge that has been mounted in the image forming apparatus after the first cartridge is dismounted decreasing to or below a first threshold value as detected by the sensor, perform an operation to control the output device in accordance with the previous remaining amount, the operation including controlling the output device to output information if the previous remaining amount is a first amount, and the information is not output by the output device if the previous remaining amount is a second amount that is less than the first amount.

2. The image forming apparatus according to claim 1, wherein the information includes a message not recommending cartridge replacement yet.

3. The image forming apparatus according to claim 1, wherein the information includes a message recommending cartridge replacement soon.

4. The image forming apparatus according to claim 1, wherein upon the remaining amount of the recording agent in the second cartridge decreasing to or below a second threshold value lower than the first threshold value, the controller controls the output device to output second information different from the information, whether the previous remaining amount is either the first amount or the second amount.

5. The image forming apparatus according to claim 1, wherein upon the remaining amount of the recording agent in the second cartridge decreasing to or below a second threshold value lower than the first threshold value, the controller decreases the second threshold value if the previous remaining amount is the second amount and maintains the second threshold value if the previous remaining amount is the first amount.

6. The image forming apparatus according to claim 1, wherein upon the remaining amount of the recording agent in the second cartridge decreasing to or below a second threshold value lower than the first threshold value, the controller decreases the second threshold value, whether the previous remaining amount is either the first amount or the second amount.

7. The image forming apparatus according to claim 1, wherein upon the remaining amount of the recording agent in the second cartridge decreasing to or below the first threshold value, no message about cartridge replacement is output by the output device if the previous remaining amount is the second amount.

8. The image forming apparatus according to claim 1, wherein the controller is further configured to determine a statistic value from a remaining amount of a recording agent in a plurality of cartridges that have been mounted to the image forming apparatus, and output different information based on the statistic value.

9. The image forming apparatus according to claim 1, wherein the recording agent is toner.

10. The image forming apparatus according to claim 1, wherein the recording agent is ink.

11. A method of controlling an image forming apparatus including a sensor configured to detect a remaining amount of a recording agent in a cartridge mounted in the image forming apparatus, the method comprising:

upon a first cartridge being dismounted, storing in a storage device, as a previous remaining amount, a remaining amount of a recording agent in the first cartridge detected by the sensor; and upon a remaining amount of a recording agent in a second cartridge that has been mounted in the image forming apparatus after the first cartridge is dismounted decreasing to or below a first threshold value as detected by the sensor, performing an operation to control an output device that is configured to output at least one of visual or audio information in accordance with a value of the previous remaining amount, the operation including controlling the output device to output information if the previous remaining amount is a first amount, and the information is not output by the output device if the previous remaining amount is a second amount that is less than the first amount.

12. The method according to claim 11, wherein the information includes a message not recommending cartridge replacement yet.

13. The method according to claim 11, wherein the information includes a message recommending cartridge replacement soon.

14. The method according to claim 11, further comprising:

upon the remaining amount of the recording agent in the second cartridge decreasing to or below a second threshold value lower than the first threshold value, controlling the output device to output second information different from the information, whether the previous remaining amount is either the first amount or the second amount.

15. The method according to claim 11, further comprising:

upon the remaining amount of the recording agent in the second cartridge decreasing to or below a second threshold value lower than the first threshold value, decreasing the second threshold value if the previous remaining amount is the second amount, wherein the second threshold value is maintained if the previous remaining amount is the first amount.

16. The method according to claim 11, further comprising:

upon the remaining amount of the recording agent in the second cartridge decreasing to or below a second threshold value lower than the first threshold value, decreasing the second threshold value, whether the previous remaining amount is either the first amount or the second amount.

17. The method according to claim 11, wherein upon the remaining amount of the recording agent in the second cartridge decreasing to or below the first threshold value, no message about cartridge replacement is output by the output device if the previous remaining amount is the second amount.

18. The method according to claim 11, further comprising:

determining a statistic value from a remaining amount of a recording agent in a plurality of cartridges that have been mounted to the image forming apparatus; and outputting different information based on the statistic value.

19. The method according to claim 11, wherein the recording agent is toner.

20. The method according to claim 11, wherein the recording agent is ink.

* * * * *